US005779509A

United States Patent [19]

Barman

[11] Patent Number: 5,779,509

[45] Date of Patent: Jul. 14, 1998

[54] INNER TUBE WATER SKIMMING AMUSEMENT

[76] Inventor: David A. Barman, 936 Moriah Rd., Norwalk, Ohio 44857

[21] Appl. No.: 797,116

[22] Filed: Feb. 10, 1997

[51] Int. Cl.[6] ..... B63B 1/00

[52] U.S. Cl. ..... 441/65; 114/253; 114/345

[58] Field of Search ..... 441/65–67, 131; 114/345, 346, 253; 472/128, 129; D21/228

[56] References Cited

U.S. PATENT DOCUMENTS

| | | | |
|---|---|---|---|
| 2,683,270 | 7/1954 | Long | 114/345 |
| 2,826,423 | 3/1958 | Erickson | 114/346 |
| 3,628,206 | 12/1971 | Mecham | 114/346 |
| 3,871,042 | 3/1975 | Farmer | 114/346 |
| 5,279,510 | 1/1994 | Remy | 441/67 |

*Primary Examiner*—Ed L. Swinehart

*Attorney, Agent, or Firm*—Fay, Sharpe, Beall, Fagan, Minnich & McKee

[57] ABSTRACT

A rigid, arched disk (10) is placed convex side down in a cloth skirt (12). The cloth skirt includes an annular bottom portion (20) which covers the convex surface of the disk and a curved upper portion (22) which ends in an annular reinforced upper edge (24). The annular upper edge (24) is smaller in diameter than the outer periphery of the arched disk (10). A zipper (28) in the skirt enables the upper annular edge to be expanded to receive the arched disk. An inflatable tube (14) is inserted into the skirt resting on a concave surface of the disk adjacent its periphery. The inflatable tube is inflated with a sufficient pressure to lock the tube, the skirt, and the disk against moving relative to each other. When the assembly sits still in the water, water flows into the concave surface of the disk through an aperture (16). When pulled by a tow rope connected with a pull loop (30), the convex surface of the disk lifts the device up out of the water, allowing water to drain through the aperture.

8 Claims, 2 Drawing Sheets

INNER TUBE WATER SKIMMING AMUSEMENT

BACKGROUND OF THE INVENTION

The present invention relates to water amusement equipment. It finds particular application in conjunction with floatation devices which are towed behind power boats.

Heretofore, truck and other large diameter inner tubes have been inflated and used as water floatation devices. Some inner tube type devices include an annular inflatable ring with a tough plastic film across the bottom of the ring. Analogously, cloth covers are available which wrap around an inner tube and provide a flexible cloth bottom. Such inner tubes come with flexible bottoms have also been used for a wide variety of water amusements.

One such use for such inner tubes is to pull them behind a power boat. However, such inner tubes have a high resistance. When used without a cloth bottom, the weight of a rider tends to push down the rearward portion of the tube which is away from the powerboat down. This causes significant drag and, in some instances, causes water to flow over the rearward portion of the inner tube. When the inner tube has a flexible bottom, the force of the water flexes the bottom inward acting as a sail or a drag shoot to slow the tube. Moreover, the high drag tends to hold the inner tube flat to the water rendering the tube relatively unmaneuverable and difficult to steer. For example, the water catching in the inward flexing base renders it extremely difficult to tip the tube to one side for sharp steering.

The present application describes a new and improved water amusement device which overcomes the above referenced problems and others.

SUMMARY OF THE INVENTION

In accordance with one aspect of the present invention, a water amusement device is provided. An arched, rigid disk has a round peripheral edge. An annular inflated tube extends along a concave side of the arched disk adjacent the round peripheral edge. The inflated tube and disk are anchored firmly together. A pull interconnects the arched disk and inflated tube with a tow rope.

In accordance with a more limited aspect of the present invention, the inflated tube and disk are anchored together with a cloth skirt which wraps around a convex surface of the arched disk and around an outer periphery and a portion of an upper periphery of the inflated tube.

In accordance with another more limited aspect of the present invention, the skirt has an upper reinforced annular edge which is disposed generally along an upper periphery of the inflated tube. The reinforced upper annular edge has a circumference which is smaller than a circumference of the peripheral edge of the arched disk. A zipper extends from the reinforced upper annular edge such that unzipping the zipper enables the disk to be inserted and removed from the skirt.

In accordance with another more limited aspect of the present invention, the arched disk has an aperture for admitting water when the device is stationary and through which water is drained when the device is towed. The lower portion of the skirt which covers the convex surface of the disk has a water porous portion over the aperture.

In accordance with another aspect of the present invention, a method is provided. A zipper in an upper portion of a cloth skirt is unzipped. The cloth skirt has a circular lower portion of a first diameter and an upper portion extending curvedly from the lower portion to an upper edge which is smaller in diameter than the first diameter. The zipper extends from and is generally transverse to the upper edge. An arched disk of substantially the first diameter is inserted through the upper edge of the skirt and the zipper is zipped up. An inflatable tube is inserted into the skirt against a concave surface of the arched disk. The inflatable tube is inflated, forcing the inflatable tube firmly against the upper portion of the skirt and firmly against a periphery of the concave surface of the disk. In this manner, the tube, the skirt, and the arched disk are forced into a firm, non-slipping relationship.

In accordance with another more limited aspect of the present invention, a pull rope is connected to the skirt and the skirt, the disk, and the inflatable tube are pulled through the water. The disk, the inner tube, and the skirt are tipped from side to side to enhance physical control.

One advantage of the present invention is that it provides very low drag resistance.

Another advantage of the present invention resides in its high maneuverability.

Yet another advantage resides in easier mounting.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
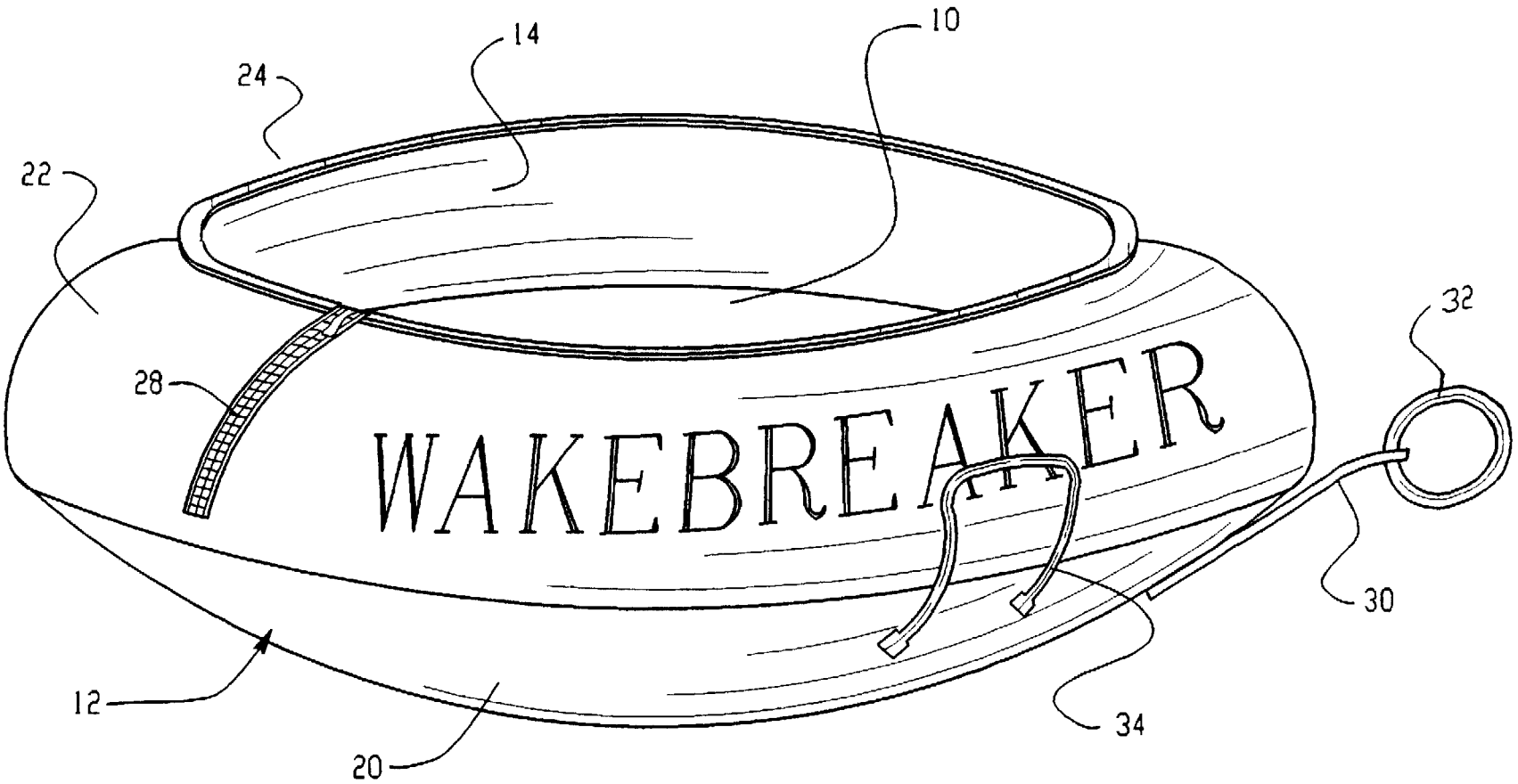
FIG. 1 is a perspective view of a water amusement device in accordance with the present invention; and, FIG. 2 is a cross sectional view of the device of FIG. 1.
Figure 2:
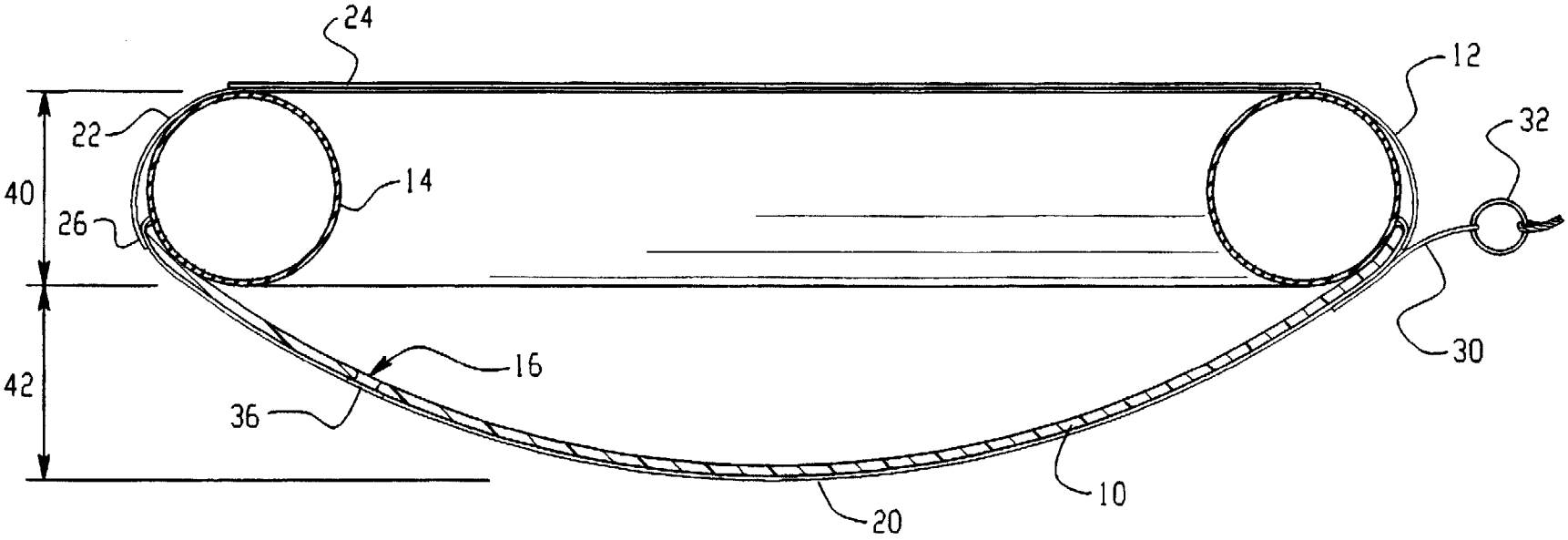

With reference to the FIGURES, a circular, arcuate disk 10, is covered by a cloth skirt 12. An annular, rubber or polymeric tube 14 is inserted into the skirt and inflated to a sufficiently high pressure to hold the inner tube, skirt, and disk together as a unit.

The disk 10 is preferably constructed of a high strength polymeric material. Suitable materials include fiber reinforced polyethylene, polypropylene, and other stiff plastic materials. Metals, such as steel or aluminum are also contemplated. Preferably, the disk is about a meter in diameter and is arched with a central height that is one sixth of its diameter. An arch whose height is about one fifth to one eighth of the diameter of the disk is also satisfactory. In the preferred embodiment, the disk has an aperture 16 about midway between the edge and the central point of greatest amplitude. When the device is stationary, water flows in through the aperture so that the device sits lower in the water. Sitting lower in the water facilitates climbing into the device. When the device is pulled behind a boat or is otherwise moving, it raises up riding on the center of the disk. The water drains through the aperture as the disk raises, removing the excess weight.

The skirt 12 has a smooth, circular bottom wall 20 constructed of a high strength cloth such as nylon or other synthetic fibers. An upper skirt wall 22 extends from the skirt bottom wall 20 around the inner tube 14 ending in an upper edge which is reinforced with a reinforcing material 24. The upper edge has a smaller diameter than the diameter of the disk such that it raps over and around the inner tube to constrain it in place. The skirt includes a reinforced region 26 along the edge of the disk 10. In the illustrated embodiment, the cloth is two layers thick in the reinforced region. Additional layers of cloth or other protective material that is resistant to abrasion by the edge of the disk 10 are also contemplated. A zipper 28 is unzipped during assembly to enable the disk 10 to be inserted through the smaller diameter opening defined by the rib 24. After the disk is inserted, the zipper is zipped up.

A cloth loop 30 is stitched to a front end of the device for interconnection with a rope connected to a powerboat for towing. In the illustrated embodiment, a metal ring 32 is connected with the loop. Handles 34 are disposed on either side of the pull loop 30 for a rider laying on his/her stomach to hold.

The skirt bottom 20 has a water porous portion 36 covering the hole 16 in the disk. Porosity may be a natural property of the cloth itself. Alternately, the porosity can be improved by cutting a aperture in the cloth and surrounding it with stitched reinforcing. Other options include a reinforced slot in the cloth, a section of stitched porous material, a permanently adhered plastic or other reinforcing material with apertures punched through both the reinforcing material and the cloth, and the like.

The upper portion 22 of the skirt is configured with a curvature such that a height 40 between a lowermost portion of the inner tube 14 and the top of the device is substantially equal to a distance 42 between the bottom of the inner tube and the bottom of the device. It is to be appreciated, that due to the constraining by the skirt and the disk, the normally circular and cross section inner tube is forced into a non circular shape. In this manner, the inner tube provides sufficient radial force to lock the inner tube, skirt, and the disk firmly against shifting relative to each other. When the device is sitting stationary in the water, water flows in through porous region 36 and aperture 16 to approximately the bottom of the inner tube. In this manner, the device has an upper portion that is out of the water by only the height 40, in the preferred embodiment, about five inches (10–15 centimeters). As the apparatus accelerates through the water, the device rides up onto the surface of the water such that substantially only the apex of the arched disk 10 is touching the water. The disk further tends to tip rearward slightly such that substantially all of the water is drained through the aperture 16 and porous region 36. By pulling on the handles 34 and shifting body weight, the rider can tip the device from side to side to enhance physical control. The enhanced physical control provides the device with greater stability and control when crossing the wake, moving toward the side of the boat, navigating turns and other maneuvers.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

I claim:

1. A water amusement device comprising:

a rigid disk having a peripheral edge;

an annular inflated tube extending along an upper side of said disk adjacent the round peripheral edge;

a means for anchoring the inflated tube and disk firmly together;

an aperture in said disk for admitting water when the device is stationary to lower its profile in the water and for exiting water when the device is being towed to drain water from the upper side of said disk; and, a pull for interconnecting the said disk and inflated tube with a tow rope.

2. A water amusement device comprising:

a rigid disk having a round peripheral edge, a concave face, and a convex face;

an annular inflated tube having a lower portion extending along the concave face of the disk adjacent the round peripheral edge; and, a cloth skirt with a central portion extending under the convex face of the disk and with a peripheral portion extending around an outer periphery and over an upper portion of the inflated tube, the inflated tube being constrained at its upper and lower portions between the disk and the peripheral portion of the skirt and the disk being constrained between the inflated tube and the central portion of the skirt such that as the tube becomes inflated, the disk is clamped between the inflated tube and the skirt, anchoring the disk, the skirt, and the inner tube together.

3. The water amusement device as set forth in claim 2 further including a pull stitched to the skirt.

4. The water amusement device as set forth in claim 2 further including:

a pull for interconnecting the skirt with a tow rope;

handles connected with the skirt on either side of the pull to be grasped by a rider to tip the disk from side to side for enhanced physical control and maneuverability.

5. A water amusement device comprising:

a rigid disk having a round peripheral edge;

an annular inflated tube extending along a concave side of the disk adjacent the round peripheral edge;

a cloth skirt wrapped around a convex surface of the disk and around an outer periphery and a portion of an upper periphery of the inflated tube, the skirt terminating in an upper, reinforced upper annular edge which is disposed generally along the upper periphery of the tube, the reinforced upper annular edge having a circumference which is shorter than a circumference of the peripheral edge of the disk; and, a zipper extending from the reinforced upper annular edge such that unzipping the zipper enables the disk to be inserted into and removed from within the skirt.

6. A water amusement device comprising:

a rigid disk having a round peripheral edge, a concave face, a convex face, and an aperture therethrough;

an annular inflated tube extending along the concave face of the disk adjacent the round peripheral edge; and, a cloth skirt having a lower portion which covers the convex face of the disk and has a water porous portion over the aperture in the disk and the skirt wraps around an outer periphery and a portion of an upper periphery of the inflated tube;

a means for anchoring the inflated tube and the disk firmly together; and, a pull for interconnecting the disk and inflated tube with a tow rope.

7. The water amusement device as set forth in claim 6 wherein the water porous portion of the skirt includes an enlarged aperture.

8. A method of assembling a water amusement device comprising:

unzipping a zipper in an upper portion of a cloth skirt, the cloth skirt having a circular lower portion of a first diameter and an upper portion extending curvedly from the lower portion to an upper edge of a smaller diameter than the first diameter, the zipper extending from and generally transversely to the upper edge;

inserting a rigid disk of substantially the first diameter through the upper edge of the skirt;

zipping up the zipper;

inserting an inflatable tube into the skirt and against an upper surface of the disk;

inflating the inflatable tube, forcing the inflatable tube firmly against a periphery of the concave surface of the disk, to force the tube, the skirt, and the disk into a firm, non-slipping relationship.

* * * * *